United States Patent [19]

Hamashima et al.

[11] 4,393,586

[45] Jul. 19, 1983

[54] SHAVING BLADE ASSEMBLY FOR ROTARY TYPE ELECTRIC SHAVER

[75] Inventors: Tetsuo Hamashima; Fumihiro Kumano, both of Hikone, Japan

[73] Assignee: Matsushita Electric Works, Ltd., Osaka, Japan

[21] Appl. No.: 173,427

[22] Filed: Jul. 29, 1980

[30] Foreign Application Priority Data

Aug. 7, 1979 [JP] Japan ..... 54-108789[U]

[51] Int. Cl.[3] ..... B26B 19/14

[52] U.S. Cl. ..... 30/43.6; 30/346.51

[58] Field of Search ..... 30/43.6, 43.5, 43.4, 30/346.51

[56] References Cited

U.S. PATENT DOCUMENTS

| | | | |
|---|---|---|---|
| 2,616,168 | 11/1952 | Dankers | 30/43.6 |
| 3,116,551 | 1/1964 | Anton | 30/43.6 |
| 3,119,180 | 1/1964 | Bruecker | 30/43.6 |
| 3,261,091 | 7/1966 | Van Der Driest | 30/43.6 |
| 3,639,979 | 2/1972 | Zuurueen | 30/43.6 |

FOREIGN PATENT DOCUMENTS

| | | | |
|---|---|---|---|
| 1066912 | 9/1958 | Fed. Rep. of Germany | 30/43.6 |
| 2000007 | 7/1970 | Fed. Rep. of Germany | 30/43.6 |
| 1188529 | 3/1959 | France | 30/43.6 |

*Primary Examiner*—Nicholas P. Godici

*Attorney, Agent, or Firm*—Burns, Doane, Swecker & Mathis

[57] ABSTRACT

Shaving blade assembly for rotary type electric shaver, improved specifically in raising and shearing abilities for such irregular beard hair as curly, bent or lying hair. The assembly comprises an outer blade of flexible steel foil and provided with hair introducing apertures including slits and orifices, the former extending substantially radially in the peripheral edge part in a substantially dome-shaped spherical hair shaving area and the latter being provided in the central part inside the edge part, and with at least a groove-shaped bent part formed as an inward recess along an annular line concentric with the peripheral wall with respect to the center axis of the blade, and an inner blade member shearing hair introduced in the apertures including the irregular hair advantageously led into the slits by inner blades carried on the member with their shearing edges resiliently slidably engaged with the inner surface of the outer blade in its radial directions rotatably about the center axis of the outer blade and respectively having an incision corresponding to the bent part of the outer blade. The slits extend axially through both inner and outer periphery walls of the bent part from the spherical surfaces of its inner and outer peripheral edges, and the incision of each inner blade separates its edge part opposed to both the peripheral walls of the bent part of the outer blade from these peripheral walls to facilitate the introduction of comparatively long irregular hair.

3 Claims, 4 Drawing Figures

SHAVING BLADE ASSEMBLY FOR ROTARY TYPE ELECTRIC SHAVER

The present invention relates to shaving blade assemblies for rotary type electric shavers and, more particularly, to improvements in the shaving blade assembly of the rotary type electric shaver comprising an outer blade made of a flexible steel foil and having apertures including many slits or orifices or their combination for introducing beard hair in a substantially dome-shaped spehrical area and an inner blade member supporting a plurality of inner blades with their shearing edges resiliently slidably contacted with the inner surface of the dome-shaped area of the outer blade as arranged in the radial directions of the outer blade, so as to rotate them with respect to the center axis of the outer blade.

Broadly, in conventional shaving blade assemblies of the rotary type electric shavers, there are two types in one of which the outer blade is provided with many radial slits for introducing hair in a substantially circular area of a rigid cast-metal piece and made by a cutting work of the same and in the other of which the outer blade is provided with many apertures for the same purpose in a circular area of a flexible steel foil by such work as punching, in either of which the outer blade part with which the inner blade's shearing edges slidably engage must be made as thin as possible so that beard hair can be shorn by the cooperating inner blades at positions closer to the root of hair as far as possible. On the other hand, in shaving, the user presses the outer surface of the outer blade against the face skin rather strongly so that the very thin outer blade will be readily deformed in its inward direction by a bending stress acting on the outer blade. Particularly, when the outer blade is pressed against the jaw part, it will be subjected to a considerably strong stress in a limited local area and, in case the outer blade is made of the rigid cast metal piece, the very thin part of the blade forming the slits will be easily deformed and hair will not be even able to be shaved. Such deformation is likely to occur particularly in the outer blade which is made of the rigid cast metal piece and in which the radial slits extend comparatively long and, in order to prevent it, there are suggested such measures that an annular groove recessed inward from the flat shaving surface of the outer blade of the cast metal piece is provided concentrically with the outer periphery of the blade, the shaving blade area of the outer blade is divided into two concentric annular parts, respective shearing edges of two annular rows of the inner blade are slidably brought into contact with respective annular shaving blade parts of such outer blade to rotate along the latter, the shaving blade part of this outer blade is made to have a strength by a substantially U-shaped cross-section of the annular groove, the side walls of the U-shaped parts are made thick to elevate the strength, and the like. However, as the shaving surface is flat, the irregular hair particularly lying along the face will be still hard to catch even if the shaving surface is pressed against the face skin. On the other hand, in the case of the flexible steel foil, the circular surface is expanded axially outward to be spherical or dome-shaped and the inner blade edges are formed to correspond to such spherical surface so that the flexibility of the flexible steel foil can be provided with a rigidity to a certain extent and the shaving surface can be positively pressed against the skin by depressing the skin with the spherical expansion so as to be more easy to catch beard hair including the irregular hair. While the irregular hair grown to be comparatively long without being substantially shaved for many days can be caught within the hair introducing apertures, these openings themselves are substantially flat as locally seen, no space or gap for introducing such irregular hair into the apertures in its state sufficiently raised state for being shorn by a next approaching inner blade is left between the shearing edges of the outer blade aperture and the skin, whereby the effect of shaving such irregular hair has not been substantially improved. So long as the ability to raise the irregularly lying hair is concerned, in the case of the outer blade made of the rigid cast piece and in which the slits extending along the shaving surface and between the inner and outer peripheries, it should be comparatively easy to introduce the irregular hair into the slits but, as the shaving blade surfaces limited to the annular bands of two rows are to be utilized to the maximum, the inner blade edges contacting these bands must be made wide enough to expand substantially over the entire width in the radial directions of these bands, necessarily no substantial gap will be left between the shearing edges of the apertures of the outer blade and the cooperative shearing edges of the inner blades slidably rotating within the outer blade, and hair even if raised and introduced into the slits will be rejected by the inner blade edges and will not be shorn. The present invention has been suggested in considerations of such defects as above in the conventional rotary type electric shaver.

A primary object of the present invention is, therefore, to provide a shaving blade assembly for the rotary type electric shaver particularly high in the abilities of raising and shearing such irregular beard hair that lying on the face surface and the shaving effect is remarkably improved in this respect.

Another related object of the present invention is to provide a shaving blade assembly of a structure which can attain the improved shaving effect at a low cost.

Still another related object of the present invention is to provide a shaving blade assembly improved in the abilities of raising and shearing the irregular hair without impairing the flexibility and strength of the outer blade made of a flexible steel foil.

Other objects and advantages of the present invention shall be made clear upon reading the following disclosure detailed with reference to certain preferred embodiments of the present invention shown in accompanying drawings, in which.

While the present invention shall be detailed in the followings with reference to the illustrated embodiments, the intention is not to limit the invention only to such embodiments shown but rather to include all possible alterations, modifications and equivalent arrangements in the scope of appended claims.

Figure 1:
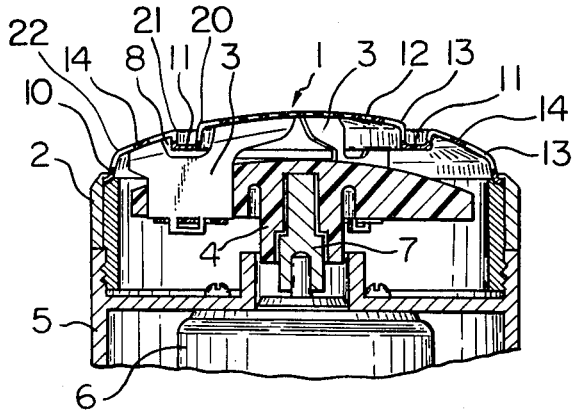
FIG. 1 is a fragmentary sectioned view of a head part of a rotary type electric shaver showing a shaving blade assembly in an embodiment of the present invention as assembled with a motor and shaver body.
Figure 2:
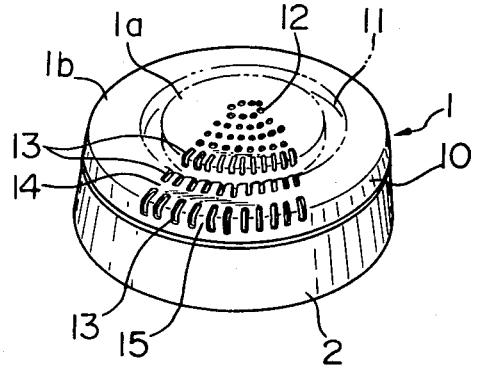
FIG. 2 is a perspective view of an outer blade of the shaving blade assembly of the embodiment of FIG. 1.
Figure 3:
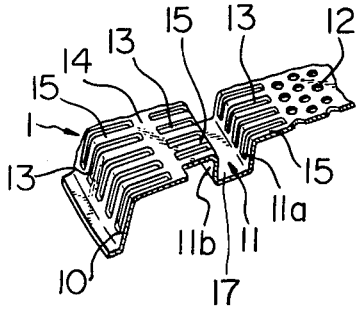
FIG. 3 is a fragmentary perspective view as magnified in particular of the peripheral edge part of the outer blade in the embodiment of FIG. 1 or 2.

Referring first to FIGS. 1 to 3, a circular outer blade 1 formed of a flexible steel foil made into a dome-shape is fitted at the peripheral edge part to an open axial end of a substantially cylindrical outer blade frame 2, and a plurality of inner blades 3 having shearing edges formed to correspond to the inner surface of the dome-shaped outer blade 1 are respectively resiliently fitted radially in a substantially disk-shaped inner blade frame 4 so as to be slidable in the axial direction of the frame within respective inner blade-containing slits provided in the frame. The inner blade frame 4 carrying these inner blades 3 receives in an axial hole a rotary output shaft 7 of a motor 6 fixed within a shaver body case 5 on the side opposite to the side on which the shearing blade edges of the inner blades 3 are projected and is mounted to the shaver head part. The outer blade frame 2 carrying the outer blade 1 is screw-fitted at the other end threaded on the inner periphery to the head part of the case 5 and the shearing edges of the respective inner blades 3 are resiliently contacted with the inner surface of the outer blade 1.

In this embodiment, the outer blade 1 is provided with an annular groove 11 formed as a groove-shaped bent part of a substantially U-shaped cross-section by bending the steel foil of the blade so as to be recessed toward the inner surface from the outer surface along an annular line concentric with the outer peripheral wall substantially adjacent the outer peripheral wall 10. The circular shaving area of the outer blade 1 is is thus divided into a central part 1*a* enclosed by the annular groove 11 with many hair introducing orifices 12 of a small diameter and an outer or peripheral part 1*b* between the part adjacent the outer peripheral side wall of the groove 11 and the outermost peripheral wall 10 with many hair introducing slits 13 of a small width and extending substantially in the radial directions of the outer blade. The slit extending direction may be of the one defining an angle with the radial direction. These slits 13 are provided continuous from the shaving area of the outer blade respectively into the outermost peripheral wall 10 and both inner and outer side walls 11*a* and 11*b* of the groove 11 toward a base 17 interconnecting those side walls. These are thus formed a plurality of three-dimensional hair introducing-apertures open inward and outward in the entire radial directions and extended in the axial direction of the shaver in the outermost peripheral wall 10 of the outer blade as well as in the both inner and outer peripheral edges walls 11*a* and 11*b* of the annular groove 11. In the illustrated case, an annular rib 14 concentric with the outermost peripheral edge and groove is provided in the outer blade 1, substantially in the middle portion of the peripheral part 1*b* between the outermost peripheral edge and the annular groove 11, whereby narrow elongated shearing blade parts 15 define the respective slits 13 and shear hair introduced into the slits in cooperation with the edges of the inner blades 3 are connected in the circumferential direction with each other through this annular rib 14 and the strength of the blade parts 15 against the bending stress is increased. That is, when the annular groove 11 is provided as separated somewhat far from the outermost peripheral wall 10 and accordingly the narrow blade parts 15 are comparatively long, this annular rib 14 will be advantageous in respect of the strength of the blade parts 15 but, when the groove 11 is provided closer to the outermost peripheral wall to render the blade parts 15 shorter, the rib 14 may not be necessary.

The respective inner blades 3 are provided with an incision 8 at a position corresponding to the annular groove 11 projecting inward from the outer blade. The shape of the incision 8 is made substantially semicircular and comparatively larger than the inward projected shape of the groove 11 from the inner surface of the outer blade so that peripheral end edge of the incision 8 is separated away from the projected surfaces of the groove 11 so as to provide a gap between the edge and the surfaces. The position and shape of the incision 8 in the respective inner blades 3 as supported on the frame 4 are made concentric with the axis of the frame 4 as well as that of the outer blade 1. It is also preferable that the outer end of the respective inner blades 3 is also separated from the inner periphery of the outermost peripheral wall 10 of the outer blade so as to provide a gap therebetween.

Figure 4:
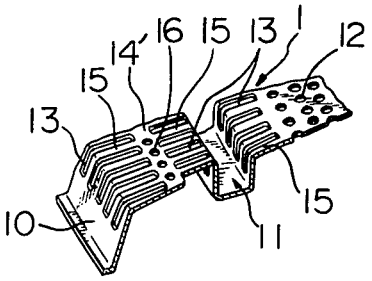
FIG. 4 is a similar fragmentary perspective view as magnified of the peripheral edge part of the outer blade in another embodiment of the present invention.

In another embodiment of the present invention shown in FIG. 4, the annular rib 14' provided in the same manner as in the embodiment described in the foregoings has many hair introducing orifices 16 of a small diameter, whereby the hair introducing opening rate is increased to be higher than in the foregoing embodiment.

The operation of the rotary type electric shaver provided with the shaving blade assembly according to the present invention having the arrangement of the respective embodiments shall be described in the followings. When a switch not shown of the shaver body is turned ON to drive the motor 6, the inner blades 3 as well as their supporting frame 4 are rotated by the output shaft 7 of the motor, and the respective shearing edges of the inner blades 3 slide along the inner surfaces of the central and peripheral parts 1*a* and 1*b* of the outer blade 1. The outer spherical surface of the blade 1 is urged against the user's face skin in this state, normal, short beard hair will be easily introduced into the hair introducing orifices 12 (and 16) and will be shorn by the rotating shearing edges of the inner blades 3 and the peripheral edges of the introducing orifices of the outer blade 1. Any irregular hair generally grown to be relatively long as lying along the face skin so as to be difficult to catch with ordinary hair introducing orifices or slits will be raised by any of the peripheral edge of the peripheral wall 10 and respective inner and outer peripheral edges of the annular groove 11 of the outer blade 1 and introduced into the slits 13. Particularly, a part of the face skin specifically between its portions pushed by the both peripheral edges of the groove 11 will rise into the groove and thereby any hair irregularly growing in this particular skin part will be perfectly raised as the skin part swells to erect the root of such hair and will be introduced into the slits at either one of the groove's inner and outer peripheral edges. The irregular hair lying along the face skin is usually not shaved frequently and grows somewhat long at irregular angles so that, as has been described above, the slits 13 provided continuous to the both side walls 11*a* and 11*b* of the groove 11 and to the outermost peripheral wall 10 from the surface area of the outer blade are effective to readily catch the irregular hair thus grown to be long at irregular angles but thus effectively raised. Here, as the outer end edges of the inner blades 3 opposed to the outermost peripheral side wall 10 as well as the edges of the incisions 8 opposed to the both side walls of the groove 11 are separated from these side walls, the irregular and long hair caused to begin to be introduced into the slits 13 in these side walls can enter the slits as stretched without being rejected by any of the edges of the inner blade which first passing the particular slit 13 in which the irregular hair is introduced but rather raise into the slit 13 on the outer blade surface side during continuous movements of the shaver itself by the user and are then easily shorn by the shearing edge of a next passing one of the inner blades 3.

Here, as seen in FIG. 1, the inner peripheral edge 20 of the annular groove 11 provided in the dome-shaped outer blade 1 projects higher than the outer peripheral edge 21. Therefore, the shaving blade assembly of the present invention has the same effect as having a second outer peripheral edge at the higher inner peripheral edge of the groove 11, in addition to the outermost peripheral edge 22 which is highly effective in raising and catching the irregularly lying hair during the movements of the shaver on the face skin in the radial directions of the outer blade. Further, the annular groove 11 increases the strength of the dome-shaped outer blade specifically in the circumferential or radial direction against the bending stress. For these effects, the cross-sectional shape of the annular groove 10 may not be limited only to the U-shape shown but may also be any other shape such as V or an arc, in any of which cases, it is necessary that the slits 13 should be three-dimensionally extended to be continuous inward to the both side walls of the groove 11 from the shaving surface of the outer blade.

In the illustrated embodiments, the annular groove 11 is shown to be provided in the form of a single and continuous shape of a closed loop. However, two or more of the annular grooves which are concentric with respect to the rotary axis of the inner blades may be provided in the outer blade, so long as the same number of the incisions corresponding to these grooves are provided in the respective inner blades. The annular groove needs not always be of a closed loop but may be the one divided into a plurality of sections arranged along the annular line, being separated from each other by radial ribs between the respective adjacent sections which further increase the strength of the outer blade in its axial direction. Further, the dome-shape of the outer blade may be made higher in the central part 1*a* inside the annular groove than in the peripheral part 1*b* or only the central part 1*a* can be made the dome-shape. In the case of providing a plurality of the annular groove, the respective cross-sectional shapes of them can be made different from each other so as to obtain the peripheral edges of different angles to thereby increase the abilities of raising and shearing the irregular hair of various angles.

According to the present invention having such arrangement as has been described above, the outer blade of the flexible steel foil formed substantially in the dome-shape is provided with the annular groove concentric with the outermost peripheral edge with respect to the rotary axis of the inner blades and with the beard hair introducing slits extending substantially in the radial directions of the outer blade over the outermost peripheral edge and both inner and outer peripheral edges of the annular groove and three-dimensionally continuous to the respective outermost peripheral wall and both inner and outer peripheral walls of the groove, and the respective inner blades cooperating with this outer blade have an incision corresponding to the groove so as to provide gaps between them and the respective peripheral walls, whereby there are brought about effects that, in addition to the shearing of the ordinary hair introduced into the ordinary hair introducing and shearing orifices provided in the central part of the outer blade and the slits provided in the peripheral part, the abilities of raising and shearing such irregular hair as are lying on the face is remarkably improved by the three-dimensional slits in the respective outermost, inner and outer peripheral edges of the outer blade and the incisions of the inner blades providing the gaps between the incisions and the both peripheral walls of the annular groove, the strength of the outer blade or particularly the strength of the narrow elongated blade parts in the peripheral part of the outer blade can be maintained by the annular groove and annular rib in the peripheral part without impairing the flexibility of the entire dome-shaped outer blade, and the annular groove of the outer blade can be simultaneously formed as a bent part of the flexible steel foil at the time of forming the entire outer blade by a compression or punching work so that the low cost can be maintained in manufacturing the outer blade with the flexible steel foil.

What is claimed is:

1. A shaving blade assembly for a rotary type electric shaver, comprising:

an outer blade including a dome-shaped flexible steel foil including inner and outer surfaces, and having a plurality of hair-introducing apertures provided in a substantially spherical central area thereof, said outer blade being provided with a groove recessed longitudinally inwardly from said outer surface thereof and extending concentrically relative to a longitudinal axis of said outer blade which passes through said central area, said groove located radially inwardly of an outer periphery of said outer blade to separate said central area of said outer blade from an outer area thereof, said groove including radially inner and outer side walls and a base interconnecting said side walls, said radially inner side wall forming with said outer surface of said outer blade a first edge, said radially outer side wall forming with said outer surface a second edge, said first edge extending longitudinally outwardly to a greater extent than said second edge, a plurality of first hair-introducing slits extending from within said central area and along said radially inner side wall toward said base, and a plurality of second hair-introducing slits extending from within said outer area and along said radially outer side wall toward said base, and an inner blade member beneath said outer blade and including:

a plurality of inner blades, each inner blade having a shearing edge corresponding to said inner surface of said outer blade and extending generally radially along a substantial portion thereof, including a substantial portion of said central area to support said outer blade, and a substantially disk-shaped inner blade frame supporting said inner blades in radial direction bringing said shearing edges into resilient and slidable contact with said inner surface of said outer blade and having an axial hole for receiving a rotary driving shaft of a motor of said shaver to rotate said inner blade member about a longitudinal axis of rotation, each of said inner blades having an incision in a position corresponding to said groove of said outer blade, and said incision having edge parts spaced from said inner and outer side walls of said groove to define therebetween a gap for allowing relatively long hair to be introduced into the gap through said first and second slits in said side walls.

2. Apparatus according to claim 1, wherein said groove extends uninterruptedly to form an endless annular groove.

3. Apparatus according to claim 1, including a third plurality of slits extending from within said outer area and longitudinally along an outer peripheral wall of said outer blade, radially inner ends of said third slits being spaced from radially outer ends of said second slits to form an annular rib in said outer area which is concentric with said rotary axis.

* * * * *